United States Patent [19]

Fugere

[11] 4,204,346

[45] May 27, 1980

[54] TRAINING SHOE FOR SOCCER

[76] Inventor: Albert L. Fugere, 4901-17th Ave., S., Seattle, Wash. 98108

[21] Appl. No.: 871,177

[22] Filed: Jan. 23, 1978

[51] Int. Cl.[2] ..... A43B 5/00; A43B 23/00

[52] U.S. Cl. ..... 36/114; 36/45; 36/133; D2/309; D2/311

[58] Field of Search ..... 36/114, 45, 465, 47, 36/48, 49, 1, 83, 128, 133; D2/309, 311

[56] References Cited

U.S. PATENT DOCUMENTS

| | | | |
|---|---|---|---|
| D. 198,157 | 5/1964 | Doss | D2/311 |
| D. 210,864 | 4/1968 | Tusa | 36/128 X |
| 2,503,586 | 4/1950 | Miller | 36/133 X |
| 3,191,321 | 6/1965 | Brutting | 36/133 |

FOREIGN PATENT DOCUMENTS

| | | | |
|---|---|---|---|
| 1944609 | 3/1971 | Fed. Rep. of Germany | 36/128 |

OTHER PUBLICATIONS

The Sporting Goods Dealer/Jan. 1977 "Shoe Protects Achilles Tendon" p. 357.

The Sporting Goods Dealer/Sep. 1977 "Training Shoes Made For Women" p. 218.

*Primary Examiner*—James Kee Chi

*Attorney, Agent, or Firm*—Cole, Jensen & Puntigam

[57] ABSTRACT

An otherwise conventional soccer shoe having two visually distinctive areas located in two regions of the shoe where proper contact with a soccer ball should be made. The first area covers a substantial part of the toe region of the shoe and the second area covers a substantial part of the instep sidewall region of the shoe. The two areas are visually distinctive from the remainder of the shoe.

2 Claims, 4 Drawing Figures

TRAINING SHOE FOR SOCCER

BACKGROUND OF THE INVENTION

The present invention relates generally to the art of sporting goods, and more particularly concerns a training aid for the sport of soccer.

Recently, the popularity of soccer has increased substantially in the United States and its popularity is likely to continue to increase at a rapid rate, particularly among young boys and girls. Soccer is primarily a kicking game, and so, in order to become adept at soccer, it is necessary to develop various kicking skills. Part of the kicking skills required concerns the ability to make contact with the ball at precise locations or areas on the shoe. Proper kicking techniques, however, are rather difficult to teach, since it is usually quite difficult for a coach to see the point of contact between the shoe and the ball in a dynamic situation. Hence, correction is often imprecise and inconsistent.

In view of the above, it is a general object of the present invention to provide a soccer training shoe which is designed to correct one or more of the disadvantages of the prior art discussed above.

It is another object of the present invention to provide such a training shoe which aids in the teaching of proper kicking techniques.

It is a further object of the present invention to provide such a training shoe which makes it relatively easy for the instructor to ascertain the point of contact of the soccer ball with the shoe.

It is another object of the present invention to provide such a training shoe which is capable of accomplishing one or more of the above objects without interferring in any way with the user's normal play.

SUMMARY OF THE INVENTION

Accordingly, the present invention is an otherwise conventional soccer shoe, which includes first and second areas which are visually distinctive from the remainder of the shoe. The first area is located in the toe region of the shoe, while the second area is located in the instep sidewall region of the shoe. In the use of the shoe, contact between a ball and either of the first and second areas of the shoe may be readily perceived by an observer.

DESCRIPTION OF THE DRAWINGS

A more accurate understanding of the invention may be obtained by a study of the following detailed description taken in connection with the following drawings in which.

DESCRIPTION OF PREFERRED EMBODIMENT

Figure 1:
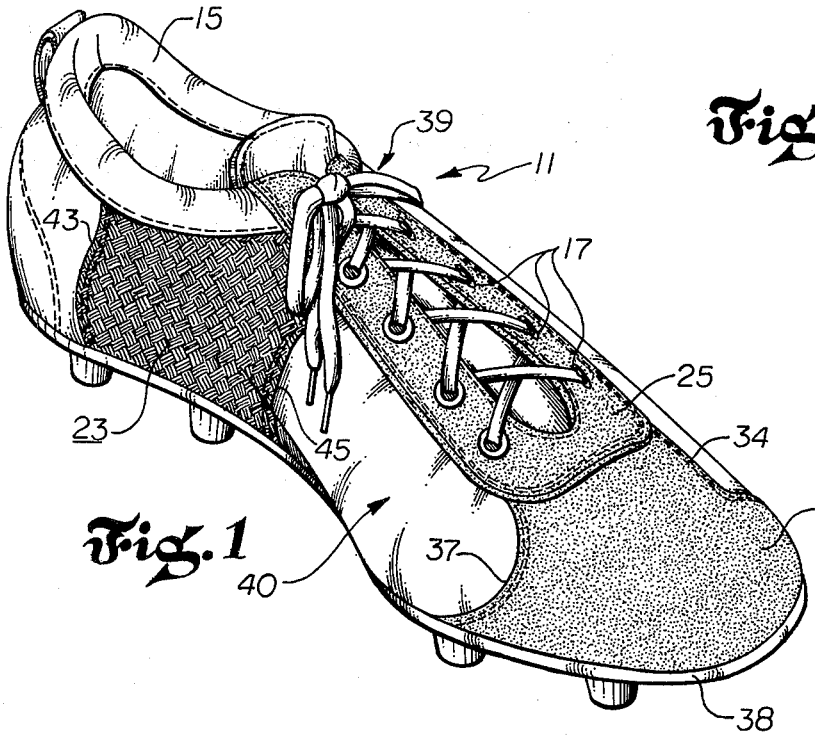
FIG. 1 is an isometric view of the soccer training shoe of the present invention, showing the instep sidewall of the shoe.
Figure 2:
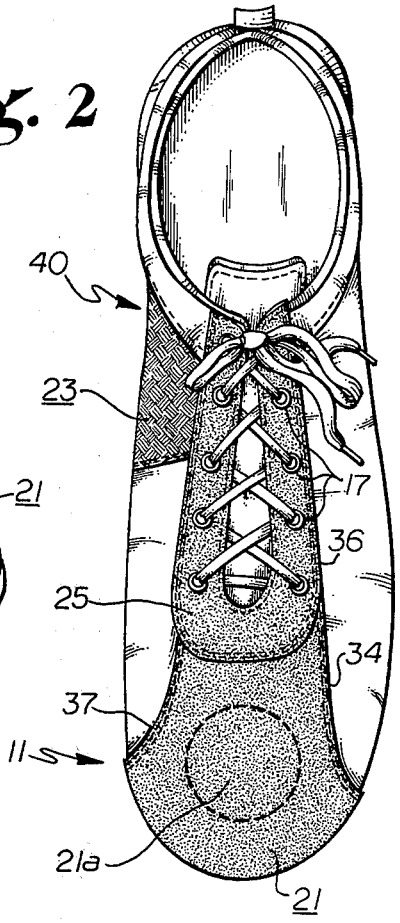
FIG. 2 is a plan view of the soccer training shoe of FIG. 1.

Referring now to FIGS. 1, 2, 3 and 4 a soccer training shoe embodying the principles of the present invention is shown generally at 11. Soccer shoe 11 is of generally conventional configuration and construction. It is a heavy-duty, low-top shoe, with a plurality of integral rubber cleats 13—13 to provide traction for the wearer. The shoe includes other standard features such as a padded ridge 15 around the opening for the foot, and heavy duty eyelets 17—17 for laces, which features are found in several different kinds of athletic shoes, including many of those used for soccer. Although only one shoe of a pair is shown in the drawings and described herein, it should be understood that both shoes in a pair will typically incorporate the principles of the present invention.

It is desirable that contact between the shoe and the soccer ball be made at two locations on the shoe, to produce proper soccer kicks. These two areas are generally in the toe region, and in the instep region of the shoe. In the soccer shoe of the present invention, those areas of the shoe are made visually distinctive from the remainder of the shoe. In the embodiment shown in the drawings, areas 21 and 23 refer to those exterior regions of the shoe which are made visually distinctive compared to the remainder of the shoe. Area 21 is located generally in the toe region of shoe 11, while area 23 is located generally in the instep sidewall region of the shoe.

In one embodiment, area 21 is a single piece of material, such as leather or vinyl, which is suitable for use in such an area of the shoe. It forms a portion of the complete shoe and is secured to other portions of the shoe in a conventional manner, such as by heavy duty stitching. A conventional eyelet strip 25, generally in the form of a U, extends down from the top edge of the shoe toward the toe of the shoe and includes five eyelets on each side. Eyelet strip 25 is, in the embodiment shown, approximately four inches long, leaving approximately three inches between the end of the eyelet strip 25 and the toe of the shoe.

Area 21 has one edge 34 which is substantially a straight line continuation of one edge 36 of the eyelet strip 25 and extends between a point slightly in from the lower end of eyelet strip 25 in the vicinity of the last eyelet to the sole 38 of the shoe. Edge 34 is on the outer sidewall 39 of the shoe, opposite from the instep sidewall 40. The configuration of the other edge 37 of area 21 is concave, with edge 37 extending from a point slightly in from the lower end of eyelet strip 25 in the vicinity of the last eyelet to the sole 38 of the shoe.

Hence, area 21 has a top edge which is stitched to the eyelet strip, two side edges as described above and a bottom edge which is secured to the sole 38 of the shoe. Area 21 is in the embodiment shown made visually distinctive from the remainder of the shoe by color, i.e. area 21 is colored red, while the remainder of the shoe, with the exception of area 23, is usually black.

Although area 21 is, in the embodiment shown, a single piece of material, it should be recognized that such a shoe construction is not critical. Rather, it is important that area 21 be made visually distinctive from the remainder of the shoe. This can be accomplished in a number of ways, such as through the use of dye, paint, or other coloring means. It should also be understood that the configuration of the visually distinctive area 21, may vary to some degree; i.e. the shape of area 21 need not follow precisely the outline shown in the drawings.

In fact, the configuration of area 21 shown in the drawings is determined more by manufacturing considerations than by ideal design considerations. The ideal point of contact between the shoe and the ball is on a spot which is at the center line of the shoe, somewhat to the rear of the point of the toe, approximately two inches from the sole over the surface of the shoe. The area of desired contact extends outward from this point in a circle approximately 1–2½ inches in diameter. This area is represented generally by a dotted circle 21*a* in FIG. 2. The configuration shown in the drawings, however, is more practical from a manufacturing standpoint, while still providing the desired results.

Figure 3:
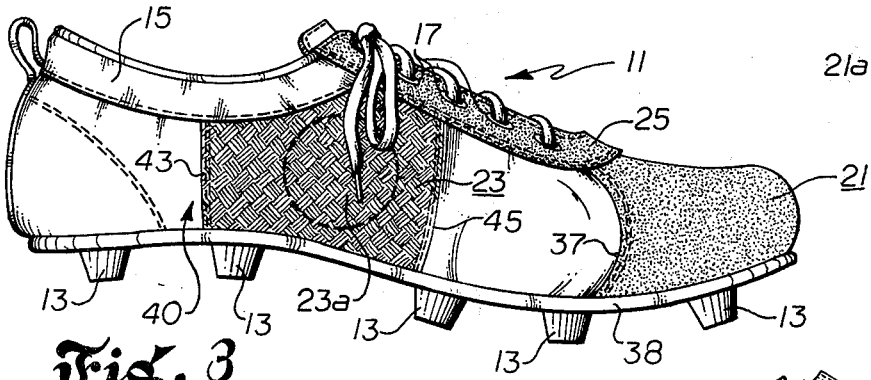
FIG. 3 is a side elevational view of the instep sidewall of the soccer training shoe of FIG. 1.
Figure 4:
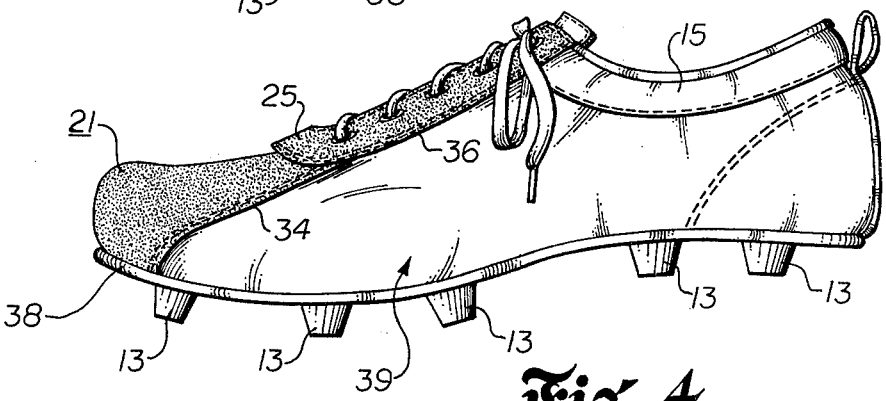
FIG. 4 is a side elevational view of the outer sidewall of the soccer training shoe of FIG. 1.

Area 23 is shown most clearly in FIGS. 1 and 3. Area 23 is located on the instep sidewall 40 of the shoe and extends from the top of the shoe to its sole. It is centered at approximately the midpoint of the length of the shoe, and in the embodiment shown is approximately 2½ inches wide.

In the embodiment shown, area 23 is a one-piece side panel, and contrasts visually from the remainder of the shoe. Generally, area 23 will be the same color as area 21, although it is not necessary, and in some cases, different colors for the two areas may even be preferred.

In detail, area 23 in the embodiment shown has a top edge which mates with an upper portion of eyelet strip 25, and a portion of padded ridge 15. It has two substantially parallel vertical side edges 43 and 45 which extend, respectively, from the padded ridge and the eyelet strip to the sole 38 of the shoe.

It should be recognized, however, that the outline of area 23 may be varied from that shown. Ideally, the point of contact between the ball and the shoe should be just behind the point on the shoe covering the instep bone, at mid-height of the shoe. An area approximately 1–2 inches in diameter centered on that point is the preferred area of contact. This is shown as area 23*a* in FIG. 3. For manufacturing reasons, however, the configuration of area 23 shown is more practical, while still providing the desired results.

Hence, a soccer shoe has been described and shown which functions as a training aid for the instruction of proper kicking techniques for soccer. It includes two visually distinctive areas, one area covering a substantial part of the toe region of the shoe, the other covering a substantial part of the instep region. The two areas are visually distinctive from the remainder of the shoe, so that the portion of contact between the shoe and the soccer ball can be readily perceived by an observer.

Although an exemplary embodiment of the invention has been disclosed for purposes of illustration, it should be understood that various changes, modifications and substitutions may be incorporated in such embodiment without departing from the spirit of the invention, as defined by the claims which follow.

What is claimed is:

1. A soccer training shoe, comprising:

a shoe suitable for use in playing soccer, wherein a first area located in the toe region of the shoe and a second area, which is separate from said first area, located in the instep sidewall region of the shoe, are visually distinctive from, and contrast with, the remainder of the shoe by color, wherein said first area is centered approximately about the longitudinal centerline of the shoe and has a top edge which is located approximately at the base of the eyelet strip of the shoe and a bottom edge which is located at the sole of the shoe and two lateral edges which extend between said top and bottom edges, said top edge being approximately 2 inches long and said bottom edge being approximately 5 inches long, and wherein said second area is centered approximately in the instep region of the shoe and extends from approximately the top of the shoe to the sole thereof and is approximately 2½ inches wide.

2. The shoe of claim 1, wherein said first and second areas are uniform throughout in color, wherein the side edges of said second area, which extend from the top of the shoe to the sole thereof, are substantially vertical and parallel to each other, and wherein the lateral edges of said first area curve outwardly and downwardly from said top edge to said bottom edge thereof.

* * * * *